US005176387A

United States Patent [19]

Taggart

[11] Patent Number: 5,176,387

[45] Date of Patent: Jan. 5, 1993

[54] PARALLEL WALL CARPET STRETCHER TOOL

[76] Inventor: Troy D. Taggart, P.O. Box 191, Chico, Tex. 76030

[21] Appl. No.: 678,023

[22] Filed: May 20, 1991

[51] Int. Cl.[5] ..... A47G 27/04

[52] U.S. Cl. ..... 294/8.6; 254/200

[58] Field of Search ..... 294/8.6; 254/200, 201, 254/204-207, 209-212

[56] References Cited

U.S. PATENT DOCUMENTS

| | | | |
|---|---|---|---|
| 61,663 | 1/1867 | Hungerford | 254/209 |
| 2,606,743 | 8/1952 | Owens | 254/212 |
| 3,706,440 | 12/1972 | Ross | 254/212 |
| 3,747,157 | 7/1973 | Szymanski | 254/200 X |
| 3,752,440 | 8/1973 | Ream | 254/209 |
| 4,230,302 | 10/1980 | Crain | 254/212 |
| 4,538,846 | 9/1985 | Alexander | 294/8.6 |
| 4,828,305 | 5/1989 | Gaddy | 294/8.6 |

*Primary Examiner*—Johnny D. Cherry
*Attorney, Agent, or Firm*—John E. Vandigriff

[57] ABSTRACT

The invention is to a tool for use with a carpet stretcher to enable the user to stretch carpet in long hallways with no openings. The stretcing tool has a bracket that attaches to the carpet stretcher, and is pivotally connected to two adjustable legs. Pivotally attached to each adjustable leg is a wall bracket. The legs and wall brackets pivot such that a force applied by the carpet stretcher also applies a force transverse to the direction the carpet is being stretched to hold the stretcher between parallel walls during the stretching operation.

5 Claims, 2 Drawing Sheets

PARALLEL WALL CARPET STRETCHER TOOL

FIELD OF THE INVENTION

This invention relates to carpet stretchers, and more particularly to a power stretcher tool enabling the user to brace against parallel walls in stretching carpet in long hallways.

BACKGROUND OF THE INVENTION

In stretching carpet during installation, it is necessary to brace the stretcher against a wall or doorway to have a fixed or anchored place against which the stretcher pushes while stretching the carpet. In general, rooms are not so large that the stretcher may push against a wall. In long hallways, however, the distance from one end of the hall to the other is too long for the average stretcher. This problem is solved in part in U.S. Pat. No. 3,747,157, issued Jul. 24, 1973, entitled CARPET STRETCHER. In this patent the stretcher is adapted to push against a back wall or doorway opening.

A similar stretcher is disclosed in U.S. Pat. No. 3,752,440, issued Aug. 14, 1973, entitled CARPET STRETCHER PIVOT BRIDGE. The stretcher in this patent is similar to the stretcher in U.S. Pat. No. 3,747,157, except that there is an angled foot or butt plate on one leg. In each patent, the foot or butt plate is rigidly fixed to the leg.

BRIEF SUMMARY OF THE INVENTION

The invention is to a carpet stretcher which permits the user to brace against parallel walls during carpet stretching. In long hallways where there are no door openings against which to push, and the end of the hall is too far from the area of carpet being stretched, the invention will push, against walls, laterally or perpendicularly to the direction the carpet is being stretched to brace the stretcher.

The parallel wall tool is attached to a carpet stretcher. A bracket is attached to the stretcher at one point, and to two adjustable legs at two other points. The adjustable legs are pivotally attached to the bracket on one end, and on the other end is a pivotally attached plate which will pivot through an approximate 180° angle. The pivotal plates butt against parallel walls. Each leg has a pivot point on each end such that when the stretcher is stretching along the length of the hall wall, the stretcher tool is pressing laterally to the hall holding the stretcher fixed during stretching.

The parallel wall tool will also push against door jams across from each other.

The technical advance represented by the invention as well as the objects thereof will become apparent from the following description of a preferred embodiment of the invention when considered in conjunction with the accompanying drawings, and the novel features set forth in the appended claims.

DESCRIPTIONS OF A PREFERRED EMBODIMENT

Figure 1:
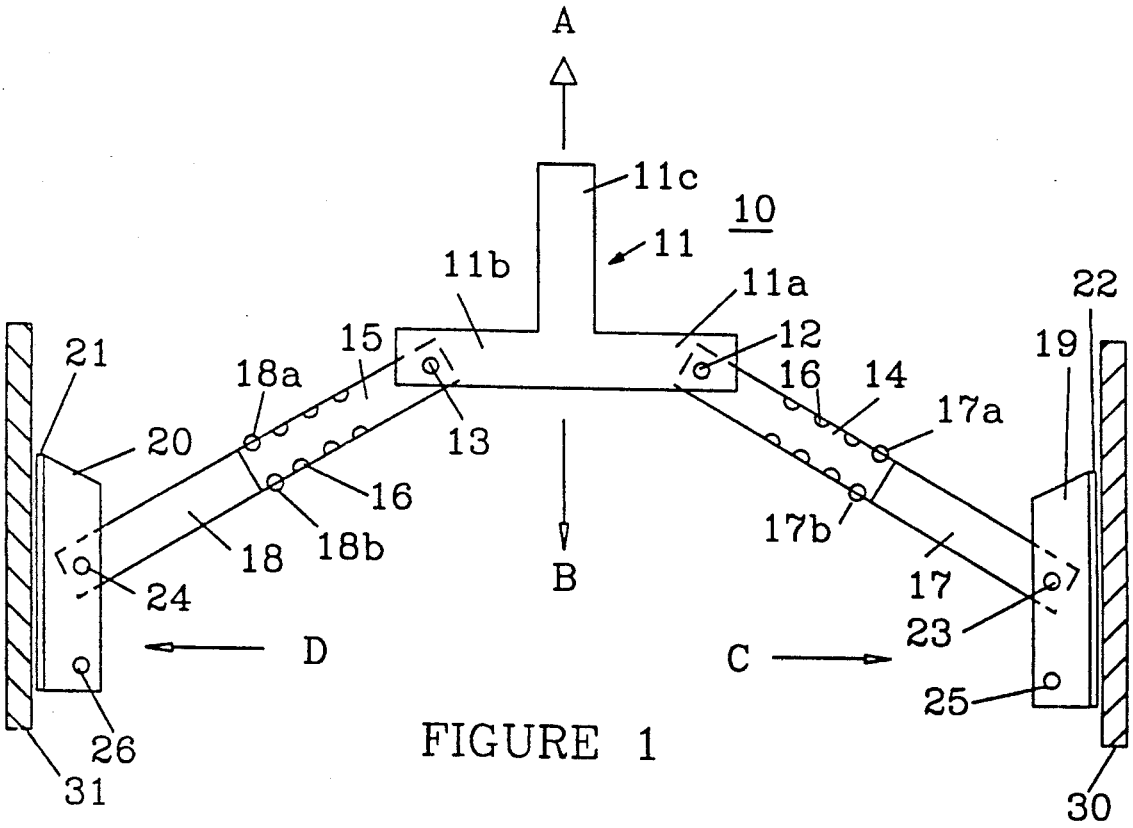
FIG. 1 illustrates the parallel wall carpet stretcher tool.

FIG. 1 illustrates a carpet stretcher tool that is used in conjunction with a carpet stretcher, and is useful in long hallways without door openings against which to brace the stretcher during stretching operation. Tool 10 is attached to a carpet stretcher by bracket 11 (indicated by arrow B). Bracket 11 is generally T-shaped with legs 11*a* and 11*b* extending perpendicular to leg 11*c*. Attached to leg 11*a* is an extendible leg made up of parts 14 and 17. Leg part 14 is attached to bracket leg 11*a* by pin 12, providing a pivotal connection between bracket leg 11*a* and extension leg 14, 17.

The length of leg 14, 17 is adjustable. Spring loaded pins 17*a* and 17*b* extend out of openings 16 in leg part 14. By pressing pins 17*a* and 17*b* inward, leg part 17 can be moved in and out of leg part 14 to adjust the overall length of leg 14, 17.

Attached to leg part 17 is bracket 19 which is pivotally connected to leg part 17 by pin 23. Bracket 19, with a rubber pad 22, is braced against wall 30 during stretching operations. The rubber pad between wall 30 and bracket 19 supplies sufficient friction to keep bracket 19 from slipping during stretching operations and prevents marking the wall.

A second leg extension assembly 15, 18 is attached to leg 11*b* of bracket 11. Leg assembly 15, 18 is adjustable with pins 18*a* and 18*b* residing in openings 16 in leg part 15. Pins 18*a*, 18*b* are spring loaded so that they may be pressed-in to adjust the length of the leg assembly. A wall bracket 20 is attached with a pivot pin 24 to leg part 18. Rubber pad 21 is attached to bracket 20 to interface with wall 31 during use.

Figure 2:
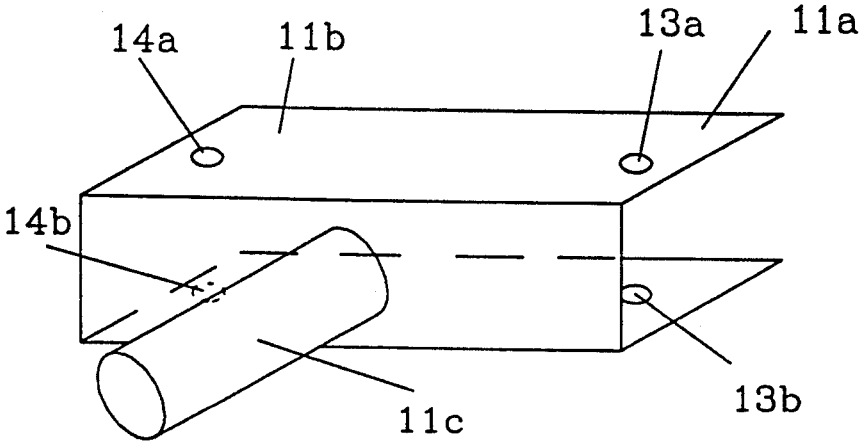
FIG. 2 shows the tool bracket that attaches to the carpet stretcher.

FIG. 2 is a more detailed illustration of bracket 11. Bracket 11 has a "U" shaped body made up of the parts 11*a* and 11*b*. A tubular member 11*c* is attached to the "U" shaped body and used to attached the bracket to a carpet stretcher. Holes 13*a*, 13*b* and 14*a*, 14*b*, are used to attach the adjustable legs to the bracket.

Figure 3:
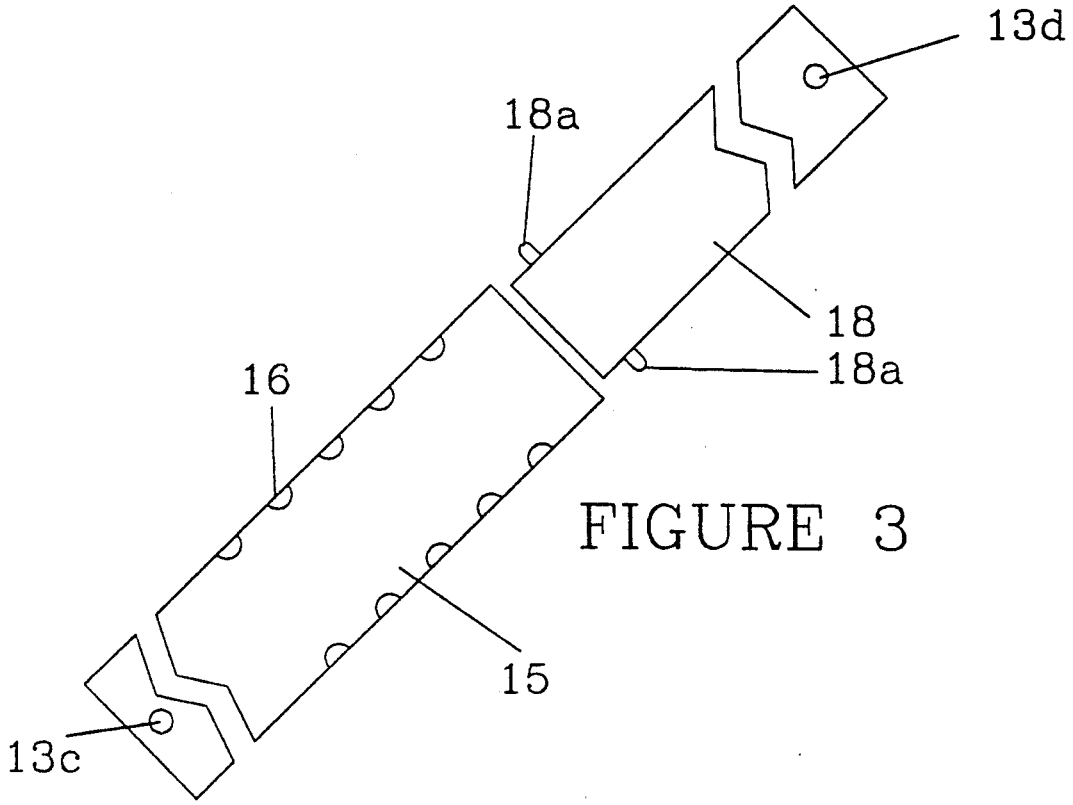
FIG. 3 shows an adjustable leg used with the stretcher tool.

FIG. 3 illustrates one of the pair of adjustable legs that is attached to the bracket 11. Leg 15, 18 is made up, for example, of two tubes, tube 18 which slides into tube 15. Tube 18 has spring loaded pins 18*a*, 18*b* which reside in openings 16 on tube 15 to lock tube 18 in a fixed position in relation to tube 15. Tube 15 has opening 13*c* which is used to pivotally connect leg tube 15 to bracket 11 with pin 13. Leg tube 18 has opening 13*d* that is used to pivotally connected leg tube 18 to bracket 20.

Figure 4:
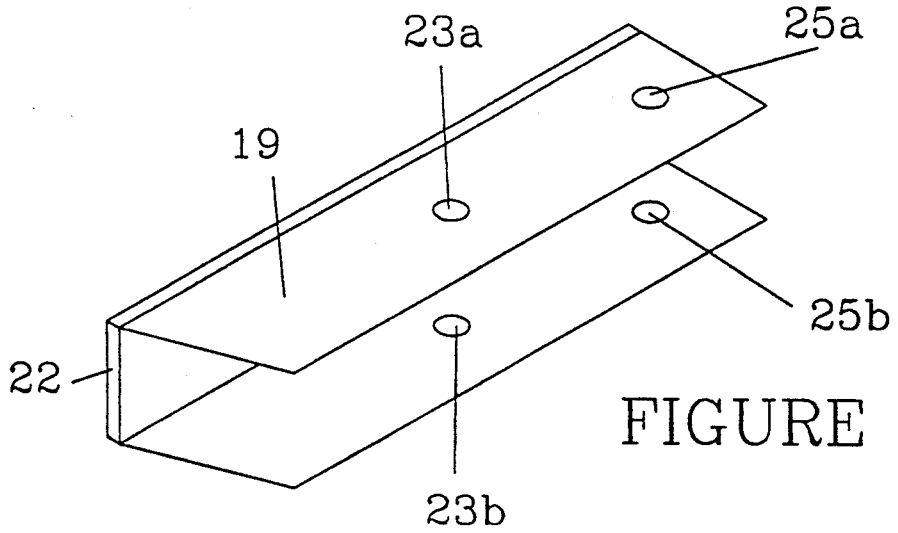
FIG. 4 shows a pivot plate which is attached to a leg.

FIG. 4 is a more detailed illustration of bracket 19. Bracket 19 is one of a pair of brackets used in the invention, the other bracket is bracket 20 (FIG. 1). Bracket 19 is attached to leg 14, 17 by pin 23 inserted through either holes 23*a*, 23*b* or 25*a*, 25*b*. Bracket 19 pivots about the end of leg 14, 17 to adjust to the wall (wall 30, FIG. 1) against which it is placed during carpet stretching. Bracket 19 has a rubber pad 22 on one face thereof.

When using the stretcher tool to brace between door facings on opposite sides of a hallway, bracket 19 is attached to leg 14, 17 using pin holes 25*a*, 25*b*. When the stretcher tool is used between parallel walls, pin holes 23*a*, 23*b* are used.

The basic operation of the stretcher tool is as follows. The stretcher tool 10 is attached to a carpet stretcher (in the direction of arrow B) and the brackets 19 and 20 are placed against parallel walls. Adjustable legs 14, 17 and 15, 18 are extended with the brackets 19 and 20 in place. As the carpet is being stretched, force is placed on the carpet tool as shown by arrow A. This forces the legs and brackets against the parallel walls preventing the stretcher from moving, allowing stretching of the carpet. Legs 14, 17 and 15, 18 pivot about pins 12 and 13, respectfully, and brackets 19 and 20 pivot about pins 23 and 24, respectively, to adjust for the distance between the parallel walls to permit brackets 19 and 20 to seat flat against the walls. Resulting force of the stretcher is shown with arrows C and D. The forces are transverse to the force applied by the stretcher during stretching operations.

I claim:

1. A carpet stretching tool for attaching to a carpet stretcher to permit stretching along hallways with no openings, comprising:

a stretcher bracket for rigidly attached to the carpet stretcher;

a pair of adjustable legs pivotally attached to said stretcher bracket; and a pair of wall brackets, one wall bracket pivotally attached to each of said adjustable legs, said wall brackets have first and second pivot holes therein for attaching to said adjustable legs, said first pivot hole in each wall bracket for attaching to said adjustable leg when bracing said stretching tool between parallel walls, and said second pivot holes for attaching to said adjustable legs when bracing said carpet stretching tool between door jams in opposite walls;

wherein a force applied to said stretcher bracket by the carpet stretcher causes a force transverse, against parallel walls of the hallway, to the force caused by the carpet stretcher to hold the carpet stretcher during stretching operations.

2. The carpet stretching tool according to claim 1, wherein said stretcher bracket for attaching to the carpet stretcher is generally T-shaped having a body member and a bar member, wherein said pair of adjustable legs are pivotally attached to opposite ends of said bar member, and said carpet stretcher is attached to said body member.

3. The carpet stretching tool according to claim 1, wherein each wall bracket has a rubber pad on one face to interface between the wall bracket and a wall against which the wall bracket presses.

4. A carpet stretching tool for attaching to a carpet stretcher to permit stretching along hallways with no openings, comprising:

a bracket, for attaching to the carpet stretcher, being generally T-shaped having a body member and a bar member in fixed relationship to each other;

a pair of adjustable legs pivotally attached to said bracket, said pair of adjustable legs pivotally attached to opposite ends of said bar member, and said carpet stretcher is attached to said body member; and a pair of wall brackets, one bracket pivotally attached to each of said adjustable legs, said wall brackets have first and second pivot holes therein for attaching to said adjustable legs, said first pivot hole in each wall bracket for attaching to said adjustable leg when bracing said stretching tool between parallel walls, and said second pivot holes for attaching to said adjustable legs when bracing said carpet stretching tool between door jams in opposite walls;

wherein a force applied to said bracket by the carpet stretcher causes a force transverse, against parallel walls of the hallway, to the force caused by the carpet stretcher to hold the carpet stretcher during stretching operations.

5. The carpet stretching tool according to claim 4, wherein each wall bracket has a rubber pad on one face to interface between the wall bracket and a wall against which the wall bracket presses.

* * * * *